US005320229A

United States Patent [19]

Mautino et al.

[11] Patent Number: 5,320,229

[45] Date of Patent: Jun. 14, 1994

[54] YOKE FOR COUPLING RAILWAY CARS UTILIZING A DRAWBAR ASSEMBLY

[75] Inventors: Peter S. Mautino, Verona; Douglas M. Hanes, Pittsburgh, both of Pa.

[73] Assignee: McConway & Torley Corporation, Pittsburgh, Pa.

[21] Appl. No.: 994,628

[22] Filed: Dec. 21, 1992

Related U.S. Application Data

[63] Continuation-in-part of Ser. No. 827,149, Jan. 28, 1992, Pat. No. 5,221,015.

[51] Int. Cl.[5] ..... B61G 9/00

[52] U.S. Cl. ..... 213/67 A; 213/67 R

[58] Field of Search ..... 213/67 R, 67 A, 62 R, 213/75 R, 50, 56, 61, 64, 68, 69, 70, 71, 72

[56] References Cited

U.S. PATENT DOCUMENTS

| | | | |
|---|---|---|---|
| 1,545,521 | 7/1925 | Richardson | 213/67 A |
| 1,557,060 | 10/1925 | Kadel | 213/67 A |
| 2,241,353 | 5/1941 | Kinne et al. | 213/67 R |
| 4,946,052 | 8/1990 | Kaim et al. | 213/62 R X |
| 5,035,338 | 7/1991 | Kaufhold et al. | 213/62 R X |
| 5,221,015 | 6/1993 | Mautino et al. | 213/67 R |

*Primary Examiner*—Robert J. Oberleitner
*Assistant Examiner*—Kevin D. Rutherford
*Attorney, Agent, or Firm*—James Ray & Associates

[57] ABSTRACT

A railway car yoke having a rear end portion, a body portion, a top forward portion and a bottom forward portion. Each of the top forward portion and the bottom forward portion include a thickened portion through which one aperture is formed to receive a connecting pin therein. A bottom strap portion of such body portion includes an aperture therein to enable adjustment of a blockout device contained within such yoke.

9 Claims, 4 Drawing Sheets

YOKE FOR COUPLING RAILWAY CARS UTILIZING A DRAWBAR ASSEMBLY

CROSS-REFERENCE TO RELATED APPLICATIONS

This patent application is a Continuation-In-Part of application Ser. No. 07/827,149 filed Jan. 28, 1992, allowed on Jan. 15, 1993, now U.S. Pat. No. 5,221,015, issued Jun. 22, 1993.

This Continuation-In-Part application is also related to a patent application titled "AN ADJUSTABLE SECURING DEVICE" application Ser. No. 07/826,797, allowed on Aug. 11, 1992, now U.S. Pat. No. 5,172,818 issued Dec. 22, 1992 and a patent application titled "AN ADJUSTABLE BLOCKOUT APPARATUS," application Ser. No. 07/826,627, allowed on Oct. 2, 1992, now U.S. Pat. No. 5,190,173, issued on Mar. 2, 1993. Each of these patent applications was filed on Jan. 28, 1992 and is assigned to the same assignee as the present application.

FIELD OF THE INVENTION

The present invention relates, in general, to a yoke used in a railway car coupling arrangement for connecting adjacent ends of a pair of railway cars together and, more particularly, this invention relates to an improved yoke for use in a slackless drawbar coupling arrangement which connects such adjacent ends of the pair of railway cars together in a substantially semi-permanent manner.

BACKGROUND OF THE INVENTION

In the railroad industry, prior to the introduction of the more powerful and efficient diesel engine in locomotives, such railroad locomotives were generally underpowered. Consequently, in order for these underpowered locomotives to start a train consist, having several cars, in motion, it was necessary to provide each end of a railway car with a draft gear assembly. These draft gear assemblies provided a requisite amount of slack required in the coupling arrangement between adjacent ends of the several cars making up the train consist. As is generally well known, in the railway art, this slack enabled start-up movement of the lead car and each of the following cars in succession. In other words, during start-up the locomotive would begin taking up the slack between it and the lead car first, then the slack in each following car in turn would be taken up. This start-up procedure enabled the lower powered locomotive to gain sufficient momentum to start the train consist in motion.

In addition, it is equally well known, in the railway art, that the buff and draft forces generated and applied to the railroad cars in such a coupling arrangement, during in track operation of the train consist were normally absorbed by these draft gear assemblies. Such draft gear assemblies were mounted in a draft gear pocket located in a yoke positioned within the center sill member of the railway car. The railway car coupler mechanism is connected to the yoke by means of a striker plate casting. Nevertheless, these prior art coupling arrangements resulted in undesirable dynamic loading on both the car bodies and their contents. These dynamic loadings usually result in considerable wear of the various coupling components on the car and depending upon the contents of such car they can even result in damage to such contents. It is obvious that wear of the coupling required considerable maintenance.

Since the introduction of the more powerful diesel locomotive in the modern railroad industry, it has been discovered the slack is no longer necessary to start the train consist in motion. In other words, a diesel locomotive provides the capability of starting the movement of a train consist, containing multiple cars, without the need for considerable amounts of slack being provided by the draft gear assemblies in the car coupling arrangements. As a result, slackless drawbar assemblies have come into widespread use in the railroad industry as the connecting means for joining together adjacent ends of a pair of railway cars. It has been demonstrated that these slackless drawbar assemblies enables the buff and draft forces generated by in-track movement to be distributed throughout the car center sill member to all of the railway cars in the train consist with less damage to both the car components and cargo.

SUMMARY OF THE INVENTION

The present invention provides an improved yoke for use in a railway car equipped with a slackless drawbar coupling arrangement. A slackless drawbar coupling arrangement is used to connect the adjacent ends of a pair of railway cars together in a substantially semi-permanent manner. The invented yoke includes a rear end portion which has a front face that forms a rear seat for a blockout device. There is a top strap portion having a first end thereof connected to a first end of such rear end portion. The top strap portion extending forwardly of the front face of such rear end portion of the yoke for a first predetermined length. Further, a bottom strap portion has a first end thereof connected to a radially opposed second end of such rear end portion of the yoke. This bottom strap portion extends forwardly of the front face of the rear end portion of such yoke for a second predetermined length. Such yoke also has a top forward portion in which a first end thereof is connected to a radially opposed second end of the top strap portion. Such top forward portion includes a portion thereof which is thicker than a predetermined thickness of the top strap portion. There is also a bottom forward portion having a first end thereof connected to a radially opposed second end of such bottom strap portion. The bottom forward portion also includes a portion thereof that is thicker than a predetermined thickness of the bottom strap portion. Each of such top forward portion and such bottom forward portion of the yoke terminates in a reduced thickness nose portion. Each of the reduced thickness nose portions has an inner surface inclined outwardly of such longitudinal centerline. A first generally round aperture is formed through such portion of the top forward portion which is thicker than the thickness of such top strap portion. This first generally round aperture having a predetermined diameter. Received in the first generally round aperture is a first portion of a drawbar connecting pin. In addition, a second generally round aperture is formed through such portion of the bottom forward portion which is thicker than such predetermined thickness of the bottom strap portion. This second generally round aperture having a predetermined diameter. The second generally round aperture receives therein a second radially opposed portion of such drawbar connecting pin. There is a first side post member connected at a first and thereof to an inner surface of such top strap portion adjacent a first outer edge thereof and intermediate the first and the second end thereof and connected at a radially opposed second end thereof to an inner surface of such bottom strap portion adjacent a first outer edge thereof and intermediate the first and the second end thereof. A second side post member is positioned radially opposite the first side post member. This second side post member is connected at a first end thereof to the inner surface of the top strap portion adjacent a second outer edge thereof and is connected at a radially opposed second end thereof to the inner surface of such bottom strap portion adjacent a second outer edge thereof. Finally, an aperture is formed through at least one of the top strap portion and the bottom strap portion for receiving therein an adjusting means used to adjust a length of an axially adjustable blockout device when such adjustable blockout device is mounted within a yoke pocket defined by the front face of such rear end portion, the inner surface of the top strap portion and the inner surface of such bottom strap portion and an inner surface of each of the first and the second side post members.

OBJECTS OF THE INVENTION

It is, therefore, one of the primary objects of the present invention to provide an improved yoke for use in a slackless drawbar coupling arrangement which can be easily and quickly retrofitted into an existing coupling arrangement or can be used to advantage in new railcar construction utilizing a slackless drawbar coupling arrangement.

Another object of the present invention is to provide an improved yoke for use in a slackless drawbar coupling arrangement which can be easily produced as a single piece casting, such as, a steel casting.

Still another object of the present invention is to provide an improved yoke for use in a slackless drawbar coupling arrangement which can withstand in-track forces of more than 1,000,000 pounds being exerted thereon.

Yet another object of the present invention is to provide an improved yoke for use in a slackless drawbar coupling arrangement which can be used with a blockout device that is capable of being adjusted in length as wear occurs in the various components in the coupling arrangement.

A further object of the present invention is to provide an improved yoke for use in a slackless drawbar coupling arrangement which is relatively light weight.

It is an additional object of the present invention to provide an improved yoke for use in a slackless drawbar coupling arrangement which will require a minimum amount of maintenance during the useful life thereof.

Still yet another object of the present invention is to provide an improved yoke for use in a slackless drawbar coupling arrangement in which the yoke can be rather easily and readily removed when maintenance on the yoke or another car component is required.

It is a further object of the present invention to provide an improved yoke for use in a slackless drawbar coupling arrangement which will reduce the wear on the car coupling components.

In addition to the several objects and advantages of the present invention discussed above, various other objects and advantages of the invention will become more readily apparent to those persons who are skilled in the railway car coupling art from the following more detailed description of the invention, particularly, when such description is taken in conjunction with the attached drawings and with the appended claims.

DESCRIPTION OF THE VARIOUS EMBODIMENTS OF INVENTION

Figure 1:
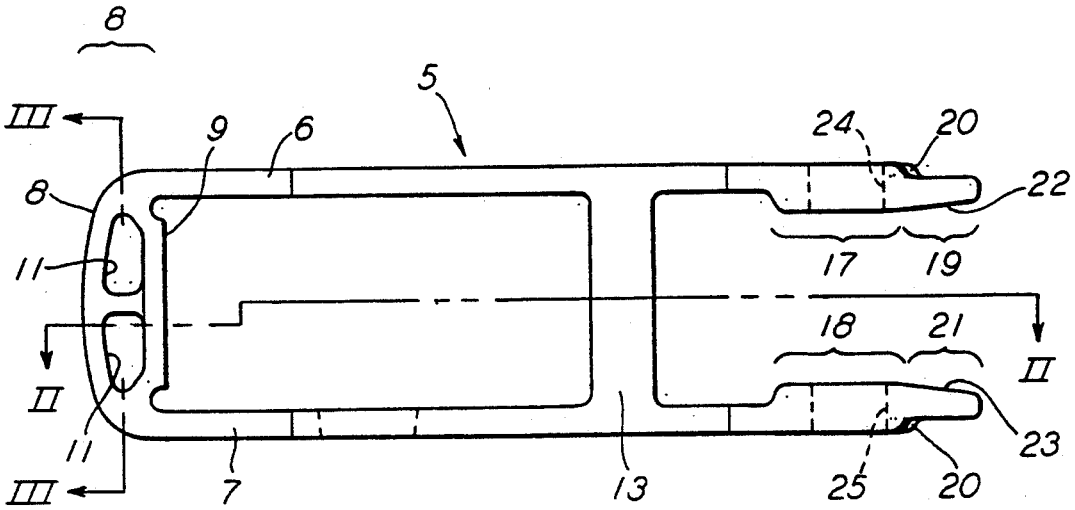
FIG. 1 is a side elevational view of a presently preferred embodiment of the yoke according to the present invention.

Prior to proceeding to the more detailed description of the instant invention it should be noted that, for the sake of clarity, identical components having identical functions have been identified with identical reference numerals throughout the several views illustrated in the drawings.

Figure 2:
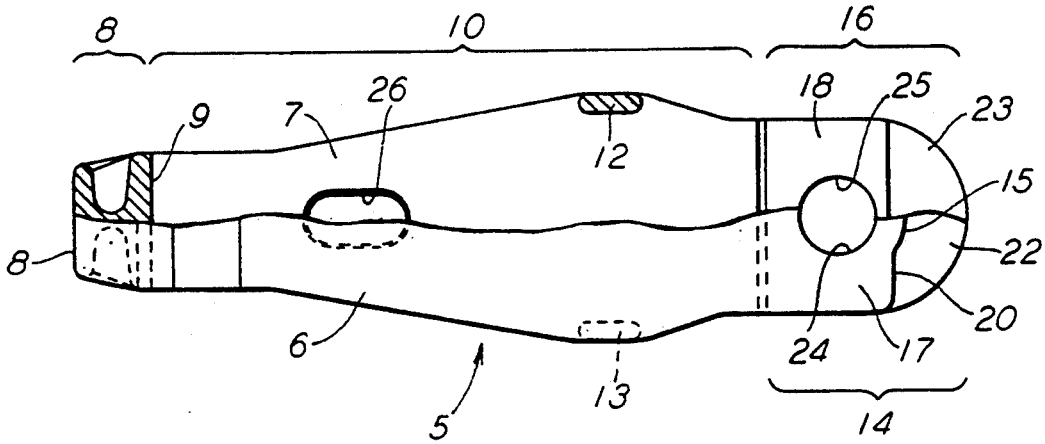
FIG. 2 is a top plan view, partly in cross-section, of the yoke illustrated in FIG. 1, taken along line II—II of FIG. 1.
Figure 3:
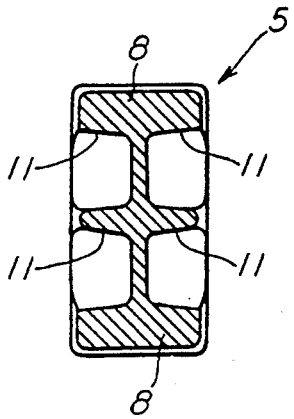
FIG. 3 is a cross-sectional elevational view of the yoke according to the present invention, taken along line III—III of FIG. 1.

Now reference is made, more particularly, to FIGS. 1, 2 and 3. Illustrated therein is a presently preferred embodiment of the yoke, generally designated 5, according to the present invention. The yoke 5 is designed for use in a slackless drawbar coupling arrangement which connects the adjacent ends (not shown) of a pair of railway cars (not shown) together in a substantially semi-permanent manner.

Figure 5:
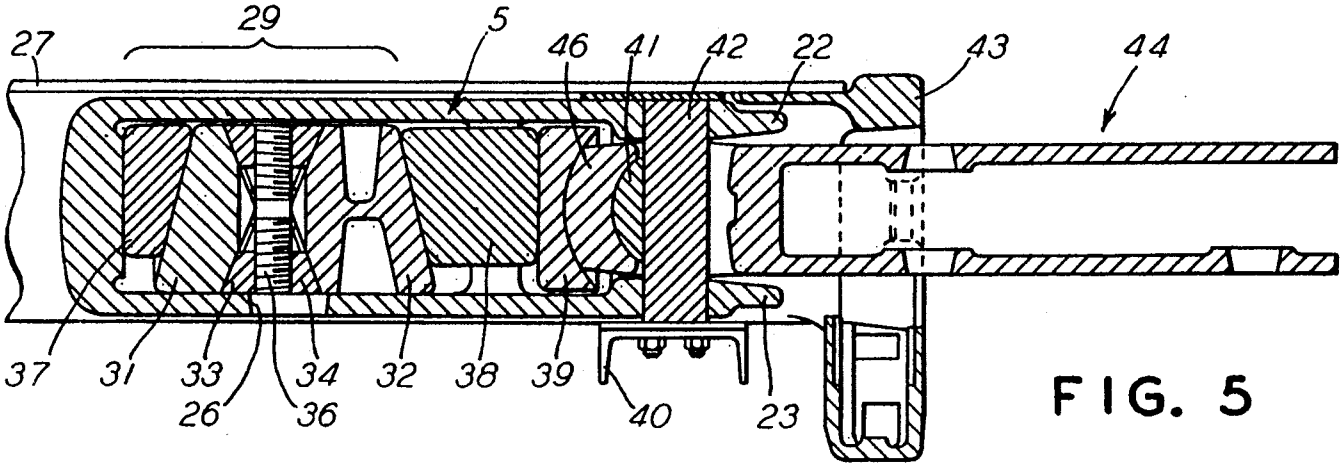
FIG. 5 is a side elevation cross-sectional view of the yoke and contained blockout device and attached slackless drawbar, taken along line V—V of FIG. 4.

The yoke 5 includes a rear end portion 8 which has a front face 9. The front face 9 forms a rear seat or bearing surface for a blockout device, generally designate-d 29 (FIG. 5). The blockout device 29 illustrated is axially adjustable. According to the presently preferred embodiment of the invention, the rear end portion 8 will include at least one cavity 11 and preferably four cavities 11 for reducing the weight of the yoke 5. Such cavities 11 being formed in the vertical side portions of the rear end portion 8.

Yoke 5 includes a body portion, generally designated 10 (FIG. 2). The body portion 10 includes a top strap portion 6 which is connected at a first end thereof to a first end of such rear end portion 8. This top strap portion 6 extends forwardly of the front face 9 of such rear end portion 8 for a first predetermined length. The top strap portion 6 has a predetermined thickness. In addition, the body portion 10 of the yoke 5 includes a bottom strap portion 7. A first end of the bottom strap portion 7 is connected to a radially opposed second end of such rear end portion 8. This bottom strap portion 7 extends forwardly of the front face 9 of the rear end portion 8 of such yoke 5 for a second predetermined length. Such bottom strap portion 7 also has a predetermined thickness. According to the presently preferred embodiment of the invention the first predetermined length of the top strap portion 6 will be substantially identical to the second predetermined length of such bottom strap portion 7. It is also preferred that the thickness of the top strap portion 6 and the bottom strap portion 7 will be substantially identical. In addition, each of the top strap portion 6 and the bottom strap portion 7 have a predetermined configuration as best seen in FIG. 2.

A top forward portion, generally designated 14 (FIG. 2), of the yoke 5 has a first end thereof connected to a radially opposed second end of such top strap portion 6. This top forward portion 14 includes a portion 17 thereof which is thicker than the predetermined thickness of such top strap portion 6.

Similarly, a bottom forward portion, generally designated 16 (FIG. 1), of the yoke 5 has a first end thereof connected to a radially opposed second end of such bottom strap portion 7. The bottom forward portion 16 also includes a portion 18 thereof which is thicker than the predetermined thickness of such bottom strap portion 7. Each of the top forward portion 14 and the bottom forward portion 16 of the yoke 5 terminates in a reduced thickness nose portion 19 and 21 (FIG. 1), respectively.

Extending forwardly of the thickened portions 17 and 18 are an upper nose portion 19 and a lower nose portion 21 formed by a step 20 extending from the outer surfaces of the thickened portions 17 and 18 to substantially horizontally extending outer surfaces of the respective nose portions 19 and 21. As best seen in FIG. 2, the step 20 comprises an arcuate portion 15 spacing the thickened portion of this part of the yoke 5 away from apertures 24 and 25 thus providing extra strength in this area to resist the forces exerted on the yoke 5 through means connecting the yoke 5 with a drawbar. Spaced from and extending forwardly of apertures 24 and 25 are inclined inner surfaces, denoted respectively by numerals 22 and 23, of the respective nose portions 19 and 21. The inner surfaces 22 and 23 are inclined outwardly of the longitudinal centerline of the yoke 5 at an angle thereto to accommodate entry of the end of a connecting drawbar into the forward portion of the yoke 5 and to enable movement of such connecting drawbar in a vertical plane.

Each nose portion 19 and 21, has an outer surface disposed substantially parallel to a longitudinal centerline of the yoke 5 and an inner surface 22 and 23, respectively, inclined outwardly of such longitudinal centerline. In the presently preferred embodiment of the invention the thicker portion 17 of the top forward portion 14 will have a thickness substantially identical to the thickness of the thicker portion 18 of the bottom forward portion 16. Further, it is presently preferred that the forwardmost extremity of each nose portion 19 and 21, respectively, of each of the top forward portion 14 and the bottom forward portion 16 will have a generally arcuate configuration which is preferably semicircular.

Figure 4:
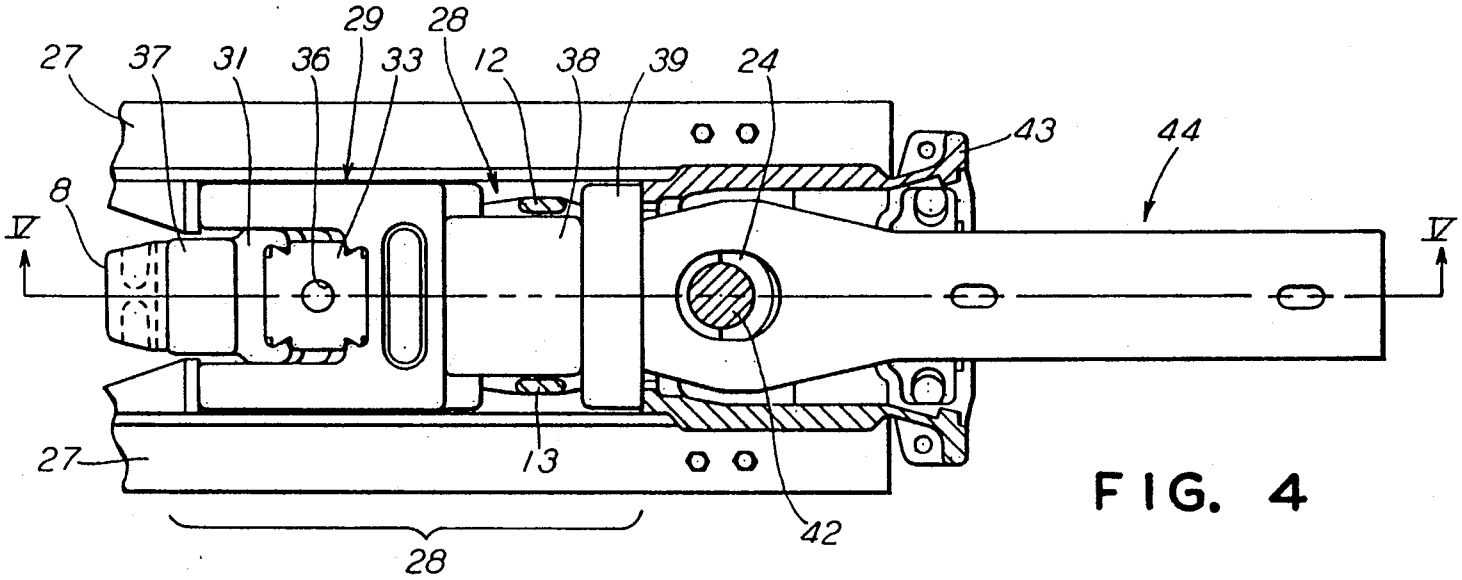
FIG. 4 is a top plan view of the inventive yoke, partly in cross-section, wherein an adjustable blockout device is mounted in the draft gear pocket of the yoke which is shown connected to a slackless drawbar.

There is a first generally round aperture 24 formed through the thickened portion 17 of the top forward portion 14 of the yoke 5. The first generally round aperture 24 has a predetermined diameter. Received in such first generally round aperture 24 is a first portion of a drawbar connecting pin member 42. Such drawbar connecting pin member 42 is illustrated in FIGS. 4 and 5. The first generally round aperture 24 has a predetermined diameter.

A second generally round aperture 25 is formed through such portion 18 of the bottom forward portion 16 which is thicker in cross-section than the cross-sectional predetermined thickness of the bottom strap portion 7. This second generally round aperture 25 has a predetermined diameter which is preferably substantially identical to the predetermined diameter of the first generally round aperture 24. Received within the second generally round aperture 25 is a second radially opposed portion of such drawbar connecting pin member 42. The yoke 5 further includes a first side post member 12. A first end of the first side post member 12 is connected to an inner surface of such top strap portion 6 adjacent a first outermost edge thereof and intermediate the first and second end of such top strap portion 6. The second radially opposed end of the first side post member 12 is connected to an inner surface of the bottom strap portion 7 adjacent a first outermost edge thereof and intermediate the first and second end of such bottom strap portion 7. Positioned radially opposite the first side post member 12 is a second side post member 13. Such second side post member 13 is connected at a first end thereof to the inner surface of the top strap portion 6 adjacent a second outermost edge thereof. The second radially opposed end of the second side post member 13 is connected to the inner surface of such bottom strap portion 7 adjacent a second outermost edge thereof.

Lastly, an aperture 26 is formed through at least one of the top strap portion 6 and the bottom strap portion 7. In the presently preferred embodiment, the aperture 26 will- be formed as an elongated slot in the bottom strap portion 7 of the yoke 5. The aperture 26 is provided for receiving therein a tool (not shown) for operating an adjusting means 36 (FIG. 5) used to adjust a length of an axially adjustable blockout device, generally designated 28. This assumes of course that such adjustable blockout device is used and is mounted within a yoke pocket defined by the front face 9 of the rear end portion 8, the inner surface of the top strap portion 6, the inner surface of the bottom strap portion 7, the inner surface of the first side post member 12 and the inner surface of the second side post member 13. The preferred predetermined configuration of said top and bottom strap portions is described below. Beginning at front face 9 each strap portion has a first straight portion 50 extending toward the side posts 12 and 13, such straight portion having a predetermined width and a predetermined length, such predetermined width preferably being about the same as the width of front face 9. Such straight portion 50 has sides 51 and 52, each of which is substantially parallel to the longitudinal center line of yoke 5. Each strap has a second diverging portion 53 extending from the end of the first straight portion to the side posts 12 and 13. Such diverging portion has outwardly diverging, substantially straight sides 54 and 55 extending from the end of the first straight portion 50 to its respective side post 12, 13. Each strap portion 6 and 7 then has a third straight portion 56 having sides 57 and 58 which lie along the outer edges of its associated side post member 12 and 13. Next each strap portion has a fourth converging portion 59 which has inwardly converging substantially straight sides 60 and 61 converging toward a predetermined width which is substantially identical with the width of its respective top forward portion 14 and bottom forward portion 16. Finally each strap portion has a fifth straight portion 62 which connects the fourth converging portion 59 with its respective top forward portion 14 and bottom forward portion 16 of yoke 5. As best seen in FIG. 2 each lengthwise half of the top and bottom straps 6 and 7 on either side of a longitudinal centerline of yoke 5 is congruent with the corresponding half on the other side of such centerline.

According to the presently preferred embodiment of this invention, the rear end portion 8 of the yoke 5 has an arcuately shaped surface disposed radially opposite such front face 9. Further, it is preferred that the rear end portion 8, the top strap portion 6, the bottom strap portion 7, the top forward portion 14, the bottom forward portion 16, the first side post member 12 and the second side post member 13 are formed as a single piece casting. Such single piece casting is preferably a steel casting. Additionally, if desired, the weight reducing cavities 11, the aperture 26 and the apertures 24 and 25 can be simultaneously cast with the yoke 5. Further, in the presently preferred embodiment of the invention the outer surface of the nose portion 19 and 21 of the top forward portion 14 and the bottom forward portion 16, respectively, of the yoke 5 will be disposed in a plane which lies substantially parallel to the longitudinal centerline of such yoke 5. Finally, as seen in FIG. 2, each of the top strap portion 6 and the bottom strap portion 7 will preferably have a predetermined configuration which will include at least two tapered portions disposed in a horizontal plane of the yoke 5.

Figure 6:
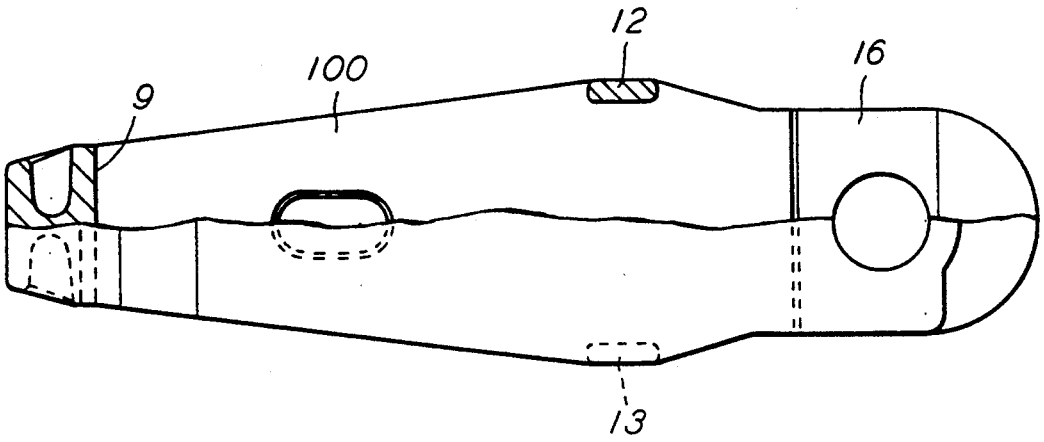
FIG. 6 is a top plan view, partially in cross-section, of an alternative embodiment of the yoke illustrated in FIGS. 1-5.

The manner of mounting the yoke 5 within a center sill member 27 of a railroad car, and the general structure and manner of mounting an axially adjustable block-out device within the yoke pocket and of connecting the yoke 5 to a drawbar 44 is illustrated in FIGS. 4 and 5. As shown in those FIGURES, a block-out assembly 28 includes an adjustable blockout apparatus, denoted generally by the number 29, and comprising a first adjustable block 31, a second adjustable block 32, a first adjusting wedge 33, a second adjusting wedge 34 and an adjusting means 36 in the form of a threaded bolt registrable with the slot 26. The blockout assembly 29 further comprises a first adjustable wedge 37, a second adjustable wedge 38 and a follower plate 39. A striker element 43 is connected to the center sill member 27 by conventional means used prior to the present invention. The yoke 5, the nose portions 19 and 21 of which are designed to fit within and extend into the striker element 43, is connected to a drawbar 44 shank by means of a drawbar connecting pin 42 extending through the apertures 24 and 25 in the thickened portions 17 and 18 of the top and bottom forward portions 14 and 16 of the yoke 5. A drawbar connecting pin bearing block 41 is provided between the pin 42 and the inside of an extremity 46 of the shank of the drawbar 44. The drawbar connecting pin 42 is held in place by a mounting member 40 secured to the center sill member. Reference is now made to FIG. 6, wherein an alternative arrangement is illustrated for the predetermined configuration of both the top strap portion 100 and the bottom strap portion (not shown). Such bottom strap portion has a configuration substantially identical to such top strap portion 100. In this embodiment, a first end of the top strap portion 100 is connected to the rear end portion 8 at a first end thereof and tapered outwardly from the front face portion 9 of the rear end portion 8 to a first side post member 12 and a second side post member 13 vertically disposed between the top strap portion 100 and the bottom strap portion intermediate the ends thereof. Each of the top strap portion 100 and the bottom strap portion then taper inwardly towards a longitudinal centerline of the yoke 5 from a respective side post member 12 and 13 towards the top forward portion 16 of the yoke 5.

Side post members 12 and 13 serve two functions. A first function is to retain wedge member 38 (FIG. 5), of the adjustable blockout device, within the yoke pocket. The second function of side post members 12 and 13 is to maintain the top strap portion 100 and the bottom strap portion in a substantially parallel position, since the space between the inner surface of the top forward portion and the bottom forward portion of the yoke 5 must be open to enable pivotable movement of the drawbar 44 in a substantially horizontal plane as the train consist negotiates a curved portion of a track structure.

Figure 7:
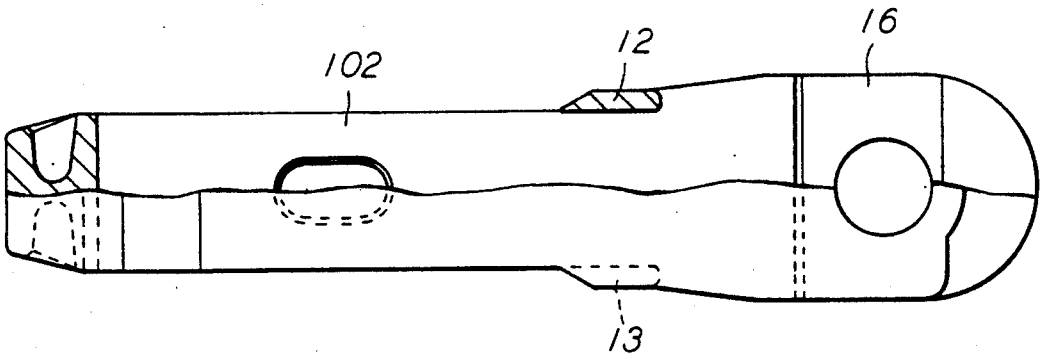
FIG. 7 is a top plan view, partially in cross-section, of another alternative embodiment of the yoke illustrated in FIGS. 1-5.

Reference is now made to FIG. 7, wherein another alternative embodiment of the predetermined configuration of the top strap portion 102 and the bottom strap portion (not shown) of the yoke 5 is illustrated. In the arrangement illustrated in FIG. 7, the top strap portion 102 and bottom strap portion have outer edges disposed substantially parallel from a first end thereof to the pair of side post members 12 and 13. From side post members 12 and 13 both the top and bottom strap portions have a tapered portion which extends outwardly from a longitudinal centerline of the yoke 5 to the forward portion 16.

Figure 8:
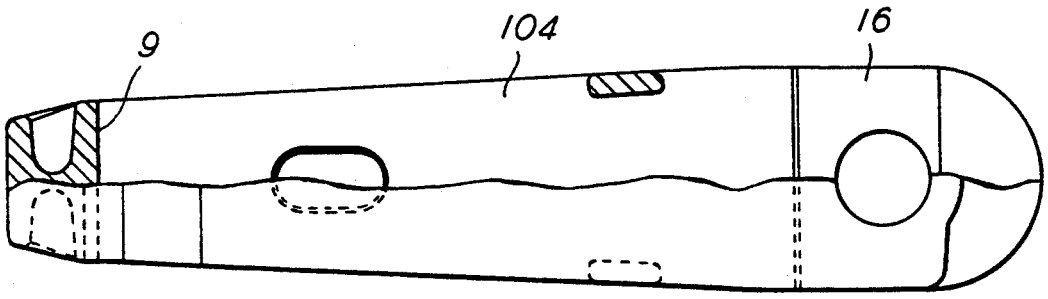
FIG. 8 is a top plan view, partially in cross-section, of still another alternative embodiment of the yoke illustrated in FIGS. 1-5.

As illustrated in FIG. 8, it is also possible for both the top strap portion 104 and bottom strap portion (not shown) to be tapered from a fist end thereof to a second end thereof. Such taper extending outwardly from the front face 9 of the rear end portion 8 to the forward portion 16.

Figure 9:
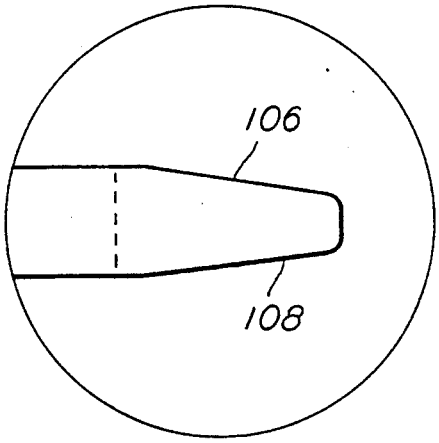
FIG. 9 is a side elevation view of an alternative embodiment of the nose portion of a yoke illustrated in each of the embodiments.

Reference is now made to FIG. 9, wherein an alternative arrangement is shown for the nose portion of the yoke 5. In this embodiment, the upper surface 106 of the nose portion is tapered upwardly from the longitudinal centerline beginning at a point adjacent the outer most edge thereof and extending to the thickened portion of such forward portion 16 and the inner surface 108 of the nose portion is tapered downwardly toward the longitudinal centerline beginning at a point adjacent the outer most edge thereof. In this arrangement, the nose portion of both the top forward portion and the bottom forward portion of the yoke 5 are substantially identical.

It can be seen from the above description that, in summary, the present invention provides a yoke for use with a slackless drawbar coupling arrangement used to connect the adjacent ends of a pair of railway cars together in a substantially semi-permanent fashion. Such yoke has a body portion that includes a pair of substantially parallel upper and lower straps and a pair of vertical side post members interconnecting the upper and the lower straps. A rear end portion is spaced rearwardly of such vertical side posts in a direction of a longitudinal centerline of the yoke and is connected to rearward extremities of the upper and lower straps. The rear end portion provides a rear draft blockout seat. Forwardly extending portions of such upper and lower straps provide an upper forward portion of the yoke and a lower forward portion of the yoke. Each of the upper forward portion and the lower forward portion includes an aperture thickened portion and a nose extending forwardly of such apertured thickened portion. An inner surface of each nose is inclined outwardly of the longitudinal centerline of the yoke. At least one of the upper and lower straps in such body portion of the yoke has a slot registrable with and adapted for reception therein of a tool for adjusting an elongated adjusting means to adjust a position of an adjustable blockout device when such blockout device is mounted within a pocket of the yoke. The yoke pocket is defined by the rear draft blockout seat, the upper and lower straps and the side post members. The forwardly extending extremities of each of the upper and the lower straps are thickened in a direction inwardly toward the longitudinal centerline of such yoke. The nose portions are reduced in thickness as compared to corresponding thickened portions by means of a step in an outer surface of the nose portions and extending across a width of the nose. Each of the nose portions have a laterally extending arcuate component retaining a thickened portion between the aperture in the thickened portion of the forward portion of such yoke and such reduced thickness nose portion.

While both the presently preferred and alternative embodiments of the yoke of the present invention have been described in detail above, it should be obvious that various other modifications and adaptations of such invention can be made by those persons skilled in the art without departing from the spirit and scope of the appended claims.

We claim:

1. A yoke used in a slackless drawbar coupling arrangement which connects adjacent ends of a pair of railway cars together in a substantially semi-permanent manner, said yoke comprising:

(a) a rear end portion having a substantially flat front face which forms a rear seat for a blockout device;

(b) a top strap portion having a first end thereof connected to a first end of said rear end portion, said top strap portion extending forwardly of said front face of said rear end portion of said yoke for a first predetermined length;

(c) a bottom strap portion having a first end thereof connected to a radially opposed second end of said rear end portion, this bottom strap portion extending forwardly of said front face of said rear end portion of said yoke for a second predetermined length, an inner surface of said top strap portion being substantially parallel to an inner surface of said bottom strap portion;

(d) a top forward portion having a first end thereof connected to a radially opposed second end of said top strap portion, said top forward portion having a portion thereof which is thicker by a predetermined amount than a predetermined thickness of said top strap portion;

(e) a bottom forward portion having a first end thereof connected to a radially opposed second end of said bottom strap portion, said bottom forward portion having a portion thereof which is thicker by a predetermined amount than a predetermined thickness of said bottom strap portion, each of said top forward portion and said bottom forward portion of said yoke terminating in a reduced thickness nose portion, said nose portion having a predetermined configuration in which an inner surface thereof is inclined outwardly of a longitudinal centerline of said yoke, said yoke being open in a vertical plane between an inner surface of each of said top forward portion and said bottom forward portion;

(f) a first generally round aperture formed through said portion of said top forward portion which is thicker than said predetermined thickness of said top strap portion, said first generally round aperture having a predetermined diameter, said first generally round aperture receives therein a first portion of a drawbar connecting pin member;

(g) a second generally round aperture formed through said portion of said bottom forward portion which is thicker than said predetermined thickness of said bottom strap portion, said second generally round aperture having a predetermined diameter, said second generally round aperture receives therein a second radially opposed portion of such drawbar connecting pin member;

(h) a first side post member connected at a first end thereof to said inner surface of said top strap portion adjacent an outermost first outer edge thereof and behind said top forward portion which is thicker than said top strap portion and intermediate said first and said second end thereof and connected at a radially opposed second end thereof to said inner surface of said bottom strap portion adjacent a first outermost edge thereof and behind said bottom forward portion which is thicker than said bottom strap portion and intermediate said first and said second end thereof;

(i) a second side post member positioned radially opposite said first side post member, said second side post member connected at a first end thereof to said inner surface of said top strap portion adjacent a second outermost edge thereof and behind said top forward portion which is thicker than said top strap portion and connected at a radially opposed second end thereof to an inner surface of said bottom strap portion adjacent a second outermost edge thereof and behind said bottom forward portion which is thicker than said bottom strap portion;

(j) an aperture spaced from said front face of said rear end portion formed through at least one of said top strap portion and said bottom strap portion at a point located between said front face of said rear end portion and a location of said first and second side post members for providing access to a tool for engaging an adjusting means to adjust an axial length of an adjustable blockout device when such adjustable blockout device is mounted within a yoke pocket defined by said front face of said rear end portion, said inner surface of said top strap portion, said inner surface of said bottom strap portion and an inner surface of each of said first side post member and said second side post member; and (k) said rear end portion and said first and second side post members providing the only connections between said top strap portion and said bottom strap portion.

2. A yoke, according to claim 1, wherein forwardly extending extremities of each of said upper and said lower straps are thickened in a direction inwardly toward said longitudinal centerline of said yoke and said nose portions are reduced in thickness as compared to corresponding thickened portions by means of a step in an outer surface of said nose and extending across a width of said nose and having a laterally-extending arcuate component retaining a thickened portion of said forward portion of said yoke and said reduced thickness nose.

3. A yoke, according to claim 2, wherein said slot is formed in said bottom strap portion and is spaced from said front face of said rear end portion and said vertical side post members.

4. A yoke, according to claim 3, wherein an outer surface of said nose portion of each forward portion of said yoke is substantially parallel to said longitudinal centerline of said yoke.

5. A yoke, according to claim 4, wherein a forward-most extremity of each of said nose portion is of generally semicircular form.

6. A yoke, according to claim 1, wherein said rear end portion includes a plurality of weight reducing cavities.

7. A yoke, according to claim 1, wherein each of said upper strap and said lower strap include at least two tapered portions.

8. A yoke, according to claim 1, wherein an outer surface of said nose portion of each forward portion of said yoke is tapered.

9. A yoke, according to claim 8, wherein a forward most extremity of each of said nose portion is of generally semicircular form.

* * * * *

UNITED STATES PATENT AND TRADEMARK OFFICE

CERTIFICATE OF CORRECTION

PATENT NO. : 5,320,229

DATED : June 14, 1994

INVENTOR(S) : Peter S. Mautino

It is certified that error appears in the above-identified patent and that said Letters Patent is hereby corrected as shown below:

Column 4, line 52, delete "designate-d" and insert --designated--.
Column 6, line 38, delete "will-be" and insert --will be--.
Column 7, line 61, after member, second occurance, insert --27--.
Column 9, line 45, delete "this" and insert --said--.

Signed and Sealed this

Thirteenth Day of September, 1994

*Attest:*

Bruce Lehman

BRUCE LEHMAN

*Attesting Officer*

*Commissioner of Patents and Trademarks*